United States Patent [19]

Larker et al.

[11] Patent Number: 4,491,540

[45] Date of Patent: Jan. 1, 1985

[54] METHOD OF PREPARING SPENT NUCLEAR FUEL RODS FOR LONG-TERM STORAGE

[75] Inventors: Hans Larker, Robertsfors; Ragnar Tegman, Umeå, both of Sweden

[73] Assignee: ASEA Aktiebolag, Västerås, Sweden

[21] Appl. No.: 358,899

[22] Filed: Mar. 17, 1982

[30] Foreign Application Priority Data

Mar. 20, 1981 [SE] Sweden ..... 8101778

[51] Int. Cl.[3] ..... G21F 9/36

[52] U.S. Cl. ..... 252/628; 252/633; 264/0.5

[58] Field of Search ..... 252/628, 629, 633; 264/0.5; 419/8, 49

[56] References Cited

U.S. PATENT DOCUMENTS

| | | | |
|---|---|---|---|
| 3,235,958 | 2/1966 | Gauthron | 419/49 |
| 4,090,873 | 5/1978 | Takamura et al. | 419/8 |
| 4,209,420 | 6/1980 | Larker | 264/0.5 |
| 4,300,056 | 11/1981 | Gagneraud | 252/629 |

FOREIGN PATENT DOCUMENTS

| | | | |
|---|---|---|---|
| 2375695 | 7/1978 | France . | |
| 2432752 | 2/1980 | France . | |
| 54-130798 | 10/1979 | Japan | 252/628 |
| 57-960 | 1/1982 | Japan | 252/628 |
| 1590108 | 5/1981 | United Kingdom . | |
| 2076582 | 12/1981 | United Kingdom | 252/628 |

OTHER PUBLICATIONS

Bergstrom et al, "The Manufacturing Method for Copper Capsules . . . " *Chem. Abstracts* 91(1979): 128508t.

*Primary Examiner*—Deborah L. Kyle

*Attorney, Agent, or Firm*—Watson, Cole, Grindle & Watson

[57] ABSTRACT

Spent fuel rods from a nuclear reactor are enclosed in a body of copper, the fuel rods being embedded in copper powder in a copper container provided with a copper lid. The container with its contents and lid are then subjected to isostatic compression at a pressure and temperature sufficient to form a coherent dense mass unit of the powder, the container and the lid which embeds the fuel rods. The container can be enclosed in a sealed gas-tight capsule prior to the isostatic compression. A preliminary isostatic compression may be conducted at a lower temperature to effect creep deformation of the container, the lid and the powder.

15 Claims, 3 Drawing Figures

METHOD OF PREPARING SPENT NUCLEAR FUEL RODS FOR LONG-TERM STORAGE

TECHNICAL FIELD

Figure 1:
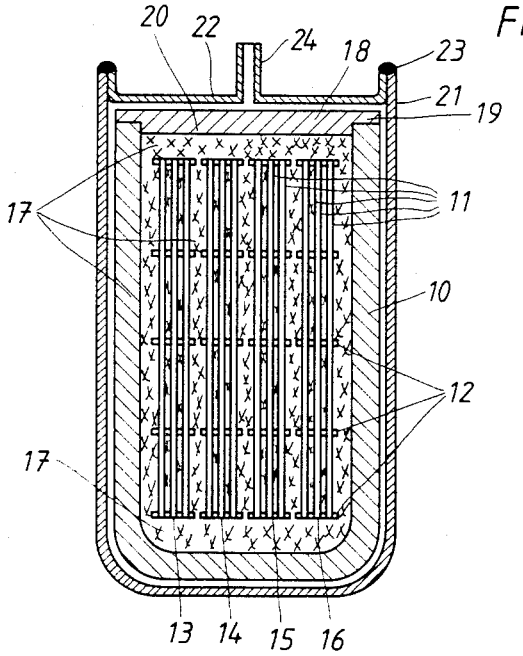

In a proposed method for preparing radioactive waste from nuclear reactors for long-term disposal, spent nuclear fuel rods from nuclear reactors are enclosed directly, i.e. without fuel reprocessing, in gas-tight containers of a corrosion-resistant material. This invention relates to an improved method of such preparation.

BACKGROUND ART

According to one known method, spent fuel rods are placed in a container of copper and embedded in lead in the container by pouring molten lead into the container and allowing it to solidify in the container. After that, the container is provided with a lid of copper which is welded to the container to form a gas-tight joint.

The present invention is based on the realization that considerable advantages can be gained if a copper powder is used instead of lead for embedding the spent fuel rods in the container and if the sealing of the container and the lid is carried out by means of isostatic compression. One advantage is that the resistance to corrosion attack is increased by the fact that the coherent mass of copper, formed from the copper powder, the container and the lid, is more resistant to corrosion than a container of copper and a body of lead within the copper container. This is due, on the one hand, to copper in itself being more resistant than lead and, on the other hand, to the protection afforded by having a coherent mass of a single material. Another advantage is that the interior of the container can be made free from cavities, which is hardly possibly when casting lead into the container and subsequently welding a lid onto the container. A further advantage is that the joint between the container and the lid after the isostatic compression is absolutely tight and completely reliable. This is because the container and the lid become a single entity without any joint, or any transition area of a different material composition existing between them. Welding together copper parts having substantial wall thicknesses, as in the known case, involves considerable difficulties and results in a joint in which the copper has a structure different from that of the adjacent material. The joint can therefore represent a weak part in the sealed container.

DISCLOSURE OF THE INVENTION

According to the invention there is provided a method of preparing spent nuclear fuel rods from a nuclear reactor for long-term storage in a copper container, which method comprises the steps of embedding the fuel rods in copper powder within the container, closing the container with a copper lid, and subjecting the closed container to hot isostatic compression at a pressure and a temperature sufficient to form the container, the powder and the lid into a coherent mass in which the spent fuel rods are embedded.

Suitably, the lidded container is enclosed in a capsule which is evacuated and sealed prior to effecting the isostatic compression. Normally, the gas-tight capsule is allowed to remain when the container is deposited for long-term storage. This capsule can be made of sheet metal and may be of the same quality copper as the container, which reduces the probability that a coherent material fault or defect in the copper material will occur. The capsule can, however, also be made of some other material, which may supplement copper for corrosion protection purposes. Stainless steel or titanium are particularly suitable examples.

The container, the lid and the copper powder are advantageously manufactured from a highly pure quality of copper with low oxygen content, such as the so-called OFHC (Oxygen Free High Conductivity) type which contains at least 99.95% Cu (including small amounts of Ag). Such a quality is assumed to give a good corrosion resistance in the finished product. Alternatively, highly pure copper which has been deoxidized with small amounts of phosphorus (max. 0.015% P) may be used.

The particles in the copper powder are preferably spherical, or at least to a major extent spherical. Particles of substantially spherical shape have good free flowing properties and therefore give a high fill factor. The fill factor may be improved by using spherical powders of at least two different grain sizes. A suitable grain size for one of two fractions is 0.5–1.5 mm and for the other of the fractions 0.1–0.2 mm. Alternatively, the latter fraction may constitute a graded fraction with a grain size of a maximum of 0.2 mm. By subjecting the container and/or fuel elements to light impacts or vibrations during filling, the fill factor for the applied copper powder may be further improved. For the same purpose, it may be desirable to temporarily locate a vibrating packing device on or in the filled copper powder. The isostatic pressing for forming the coherent dense mass of the container, lid and powder is suitably carried out at a pressure of at least 10 MPa and at a temperature in the range of 600°–800° C., or at a temperature in the range of 500°–800° C.

In order to achieve a tight and permanent joining of the lid to the container in a rapid and reliable manner, during the isostatic pressing, without having to employ high temperatures and long treatment times, it is important that the joining surfaces, prior to being applied against each other, are freed from foreign substances by some suitable treatment, for example scraping, shot blasting, abrading with metal brushes, washing or etching. It is particularly important that the joining surfaces are freed from oxide depositions, which may be done by washing with acid or by reduction of the oxide coating with hydrogen gas at elevated temperature.

By giving the joining faces a certain texture such as grooves, scratches or an embossed pattern, parts of the contact surfaces are subjected, during the pressure application, to a strong plastic deformation while at the same time fresh and clean metal surfaces are generated. This causes the joint region to become more reactive, which facilitates the formation of a tight joint between the lid and the container during the isostatic pressing. Further, by said texturing of the joining surfaces and by giving contact portions between lid and container, on at least one of these, stepped or conical shape, or by constructing the lid with a central stud passing into the container with a close fit within the container, it is possible to extend the actual length of the joint, relative to that obtained with a plane and smooth lid by a factor of 2–3, which additionally ensures the formation of a coherent dense mass from the lid and container during the subsequent hot isostatic pressing. In addition, the accurate fitting of the lid on the container is facilitated by the mechanical guidance provided with a stepped design of the contact portions or a central stud, while at the same time displacements of the positions of the parts during pressure application and compaction are prevented.

In order to embed the fuel rods separately and in predetermined relative positions within the container, they may be held in desired spaced-apart positions within the container during the feeding in of the copper powder and during the sealing of the container, by suitable spacing elements. According to an advantageous embodiment, the spacing elements are the spacers, normally of stainless steel, used in the nuclear reactor to support the fuel rods in bundles during operation of the nuclear reactor. After the fuel rods have been exhausted in the reactor, the complete fuel rod bundles can then, without any further assembly work, be removed from the reactor and placed in the copper container for treatment according to the present invention whenever containment and long-term storage of them is necessary. According to another advantageous embodiment of the invention, the spacing elements are made of copper. This embodiment is particularly suitable if the fuel rod bundles are to be partially dismantled. After the isostatic pressing, spacing elements of copper with a surrounding copper powder give rise to a more homogeneous unit with fewer transition areas between different materials.

Before carrying out the isostatic pressing of the filled and lidded container to form a coherent dense mass of the copper components, the filled and lidded container can be subjected to a creep deformation by subjecting it to isostatic compression at a lower temperature than that which is to be used during the final pressing. For example, the container can be arranged in the sealed gas-tight capsule which is used in the final pressing, or the lid can be gas-tightly joined to the container if the capsule is dispensed with. For the creep deformation a pressure of at least 10 MPa and a temperature in the range of 300°–500° C. are preferably employed. By subjecting the copper parts to isostatic compression at a lower temperature than that which is used during the final joining together of the parts, an efficient supporting pressure on the cladding tubes of the fuel rods during continued heating is obtained. In this way it is possible to eliminate, or at any rate considerably reduce, the risk that gas present in the cladding tubes will generate a pressure sufficient to cause creep rupture in the tubes when heating them to the temperature necessary to form a coherent unit of copper powder, container and lid. The spent fuel rods contain gases, among others of helium and fission gases, which even at room temperature may provide a pressure of 50–80 bar within the fuel rod cladding tube.

Figure 3:
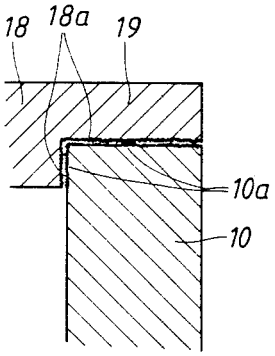
Figure 2:
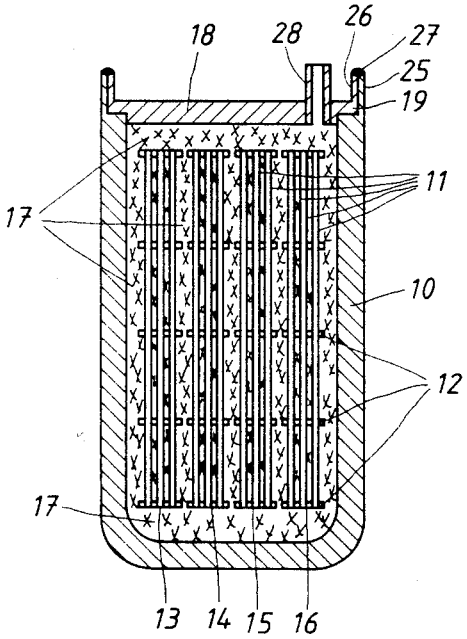

Methods in accordance with the invention will now be described in greater detail, by way of example, with reference to the accompanying drawing, in which:

FIGS. 1 and 2 illustrate two embodiments of a container with fuel rods, powder and lid prepared for employment in the method, but before any isostatic pressing has been effected, and FIG. 3 shows a detail of the embodiment of FIG. 1 on an enlarged scale.

Referring first to FIG. 1, a number of spent nuclear fuel rods 11 from a nuclear reactor are arranged in a copper container 10. The fuel rods, which consist of zircaloy cladding tubes containing pellets of uranium dioxide, remaining attached to spacers 12 which retained the fuel rods in bundles in the nuclear reactor. These spacers 12 can be of stainless steel. In FIGS. 1 and 2, four fuel rod bundles 13, 14, 15 and 16 are shown. The fuel rod bundles may possibly rest on supports (not shown) spacing them from the bottom of the container 10 or they can be placed on a bed of copper powder. The container 10 is then filled in its entirety, while being vibrated, with a mixture 17 consisting of 70 parts by weight of a copper powder with spherical particles having diameters in the range 0.5–1.5 mm and of 30 parts by weight of a copper powder with spherical particles having diameters in the range 0.1–0.2 mm. A lid 18 of copper is then placed on the container 10. The container, the lid and the powder are all of the previ ously mentioned copper quality containing 99.95% Cu (including small amounts of Ag). The circumferential part 19 of the lid 18, which makes contact with the container 10, has a stepped shape to provide a central lower portion 20 of the lid which projects into the container. The confronting surfaces 10*a* and 18*a* of the container 10 and the lid 18, respectively, are roughened or otherwise textured, as is indicated in FIG. 3. The surfaces 10*a* and 18*a* are well cleaned and freed from oxide by acids before fitting the lid 18 onto the container 10. The container 10, its contents 11, 12, 17 and the lid 18 are arranged in a capsule 21 of copper sheet or of steel sheet, the lid 22 of which, made of copper sheet or steel sheet is welded to the capsule by forming a gas-tight joint 23. The lid 22 is provided with a tube 24 of copper or steel, respectively, which can be connected to a vacuum pump for evacuation of the capsule with its contents. After evacuation, the capsule is sealed by closing the tube 24 above the upper surface of the lid (e.g. by cold or hot welding).

The sealed capsule 21, 22 with its contents is then subjected to hot isostatic pressing in two stages employing a gas, for example argon, as the pressure medium in a high pressure furnace of the kind disclosed in U.S. Pat. No. 4,172,807. In the first stage, the capsule is subjected to a pressure of 80 MPa and to a temperature of 450°–500° C. for a period of 2–10 hours. During the first stage, the copper in the container 10, the lid 18 and the powder 17 undergo a creep deformation, which results in the copper filling powder 17 providing an efficient all-round support for the fuel rods 11, which prevents creep rupture in the zircaloy cladding tubes as a result of an increase in pressure of the gas, present in these tubes, during continued heating. However, this first stage does not result in the powder grains, the container and the lid forming a coherent unit with a fully developed bonding. Such a result is achieved during the second stage in which the temperature in the furnace is increased to about 700° C., while the pressure is increased, without additional supply of gas, to about 100 MPa, and by maintaining these conditions for 1–4 hours. When the capsule with its contents has been subjected to the second stage of the isostatic pressing, the capsule with its contained material is allowed to cool, whereafter the pressure is reduced to atmospheric pressure and the capsule is removed from the furnace. Normally, the capsule is allowed to remain around the compressed product 10, 11, 12, 17, 18 when it is to be deposited for long-term storage.

In an alternative example, the mixture 17 consists of 55 parts by weight of a copper powder with spherical particles having diameters in the range 0.8–1.0 mm and 45 parts by weight of a copper powder with spherical particles having diameters in the range 0.2 mm and below. A fill density of 81% of the theoretical density can then be obtained by vibrational filling. After evacuation of the capsule 21 with its contents, the capsule is heated to 350° C., whereupon it is filled with hydrogen gas with a pressure of 0.1 MPa. When this temperature has been maintained for ½ hour, the capsule is re-evacuated and is then refilled with hydrogen gas. This treatment with hydrogen gas at 350° C. is repeated a plurality of times, for example 7 times, suitably with a successively longer treatment time after each refilling. The final treatment time could be 10 hours. The cyclic treatments with hydrogen gas result in a reduction of possibly existing oxides of copper. After completion of the cyclic treatments with hydrogen gas, the capsule 21, 22 is evacuated and sealed as in the previously described case. During the isostatic pressing, a temperature of 400°–450° C. is used in the first stage and a temperature of 525° C. is used in the second stage. This described alternative example is otherwise carried out under the same conditions as the previously mentioned case.

In the embodiment illustrated in FIG. 2, the surrounding capsule 21, 22 is dispensed with. Instead, the container 10 and the lid 18 are provided with flanges 25 and 26, respectively. After placing the fuel rods 11 in the container and filling this with copper powder 17, the flanges 25 and 26 are joined together by welding or cold pressing to form a gas-tight joint 27. The lid 18 is provided with a tube 28 of copper which is sealed after evacuation of the container and its gas-tight lid. After sealing of the tube 28, the closed container is subjected to isostatic pressing in two stages in either of the manners described for the sealed capsule in accordance with FIG. 1.

What is claimed is:

1. A method of preparing spent nuclear fuel rods from a nuclear reactor for long-term storage in a copper container, which method comprises the steps of:

embedding the fuel rods in copper powder within the container, closing the container with a copper lid, and subjecting the closed container to hot isostatic compression at a pressure and a temperature sufficient to form the container, the powder and the lid into a coherent mass in which the spent fuel rods are embedded.

2. A method as claimed in claim 1 which includes the further step of enclosing the lidded container in a capsule which is evacuated and sealed prior to effecting the isostatic compression.

3. A method according to claim 2, in which the capsule is of copper.

4. A method according to claim 1 or claim 2, in which the hot isostatic compression is carried out at a pressure of at least 10 MPa and at a temperature in the range of 500°–800° C.

5. A method according to claim 1 or claim 2, in which the fuel rods are spaced-apart from each other in the container by means of spacing elements.

6. A method according to claim 5, in which the spacing elements consist of the spacers supporting the fuel rods in bundles in the nuclear reactor.

7. A method according to claim 5, in which the spacing elements are of copper.

8. A method according to claim 1 or claim 2, in which a region of one of said container and said lid which makes contact, respectively, with one of said lid and said container, comprises a cylindrical surface and an intersecting annular surface.

9. A method according to claim 8, in which said cylindrical and annular surfaces intersect at right angles.

10. A method according to claim 1 or claim 2, in which the lid is provided with a part which extends into the container and fits closely therein.

11. A method according to claim 1 or claim 2, in which surfaces of the lid which confront surfaces of the container, when the lid is closing the container, are textured to improve the seal between these surfaces.

12. A method according to claim 1, in which said surfaces are textured by an operation selected from grooving, scratching and surface patterning.

13. A method according to claim 1, in which prior to the isostatic pressing of the container, its contents and the lid at a pressure and a temperature sufficient for forming a coherent mass thereof, the container with its contents and its lid gas-tightly joined to the container, is subjected to an isostatic pressing at a lower temperature for achieving a creep deformation of the container, its contents and the lid.

14. A method according to claim 2, in which prior to isostatic pressing of the capsule and its contents at a pressure and temperature to form a coherent mass of the container, the powder and the lid, the gas-tight capsule is subjected to an isostatic pressing at a lower temperature for achieving a creep deformation of the container, its contents and the lid.

15. A method according to claim 13 or claim 14, in which the isostatic pressing for achieving creep deformation is carried out at a pressure of at least 10 MPa and at a temperature in the range of 300°–500° C.

* * * * *